US010588340B2

(12) United States Patent
Bell et al.

(10) Patent No.: US 10,588,340 B2
(45) Date of Patent: Mar. 17, 2020

(54) TREATED TOBACCO AND PROCESSES FOR PREPARING THE SAME, DEVICES INCLUDING THE SAME AND USES THEREOF

(71) Applicant: BRITISH AMERICAN TOBACCO (INVESTMENTS) LIMITED, London (GB)

(72) Inventors: Sally Bell, London (GB); Mark Forster, London (GB); Jeremy Phillips, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 122 days.

(21) Appl. No.: 14/912,400

(22) PCT Filed: Aug. 20, 2014

(86) PCT No.: PCT/GB2014/052548
§ 371 (c)(1),
(2) Date: Feb. 16, 2016

(87) PCT Pub. No.: WO2015/025158
PCT Pub. Date: Feb. 26, 2015

(65) Prior Publication Data

US 2016/0205992 A1 Jul. 21, 2016

(30) Foreign Application Priority Data

Aug. 21, 2013 (GB) ..... 1314917.4

(51) Int. Cl.
*A24B 15/28* (2006.01)
*A24B 15/16* (2020.01)
*A24F 47/00* (2020.01)

(52) U.S. Cl.
CPC ..... *A24B 15/287* (2013.01); *A24B 15/16* (2013.01); *A24F 47/004* (2013.01)

(58) Field of Classification Search
CPC ..... A24B 15/287; A24B 15/16
(Continued)

(56) References Cited

U.S. PATENT DOCUMENTS 560,483 A * 5/1896 Du Brul ..... B02C 4/06 131/322
1,538,265 A * 5/1925 Arnold ..... C07D 401/04 202/175

(Continued)

FOREIGN PATENT DOCUMENTS

BE 859294 1/1978
BE 859294 A * 1/1978 ..... A24B 15/243

(Continued)

OTHER PUBLICATIONS

Household Ammonia MSDS (Material Safety Data Sheet, Household Ammonia Church & Dwight Co., Inc., https://www.conncoll.edu/media/website-media/offices/ehs/envhealthdocs/Ammonia.pdf, Published Feb. 22, 2001).*

(Continued)

*Primary Examiner* — Eric Yaary
*Assistant Examiner* — Russell E Sparks
(74) *Attorney, Agent, or Firm* — Patterson Thuente Pedersen, PA

(57) ABSTRACT

Embodiments provides treated tobacco material having a pH of at least 9 and a moisture content of no more than 20% based on the dry weight of the tobacco. Embodiments also provide a process for treating tobacco material to increase its pH to at least 9, the process comprising applying a basic solution to the tobacco material to be treated, and drying the material to produce a treated tobacco material with a mois- (Continued)

ture content of no more than 20%. Embodiments also provide devices comprising the treated tobacco material, and uses of the treated tobacco material.

15 Claims, 4 Drawing Sheets

(58) Field of Classification Search
USPC ..... 131/309
See application file for complete search history.

(56) References Cited

U.S. PATENT DOCUMENTS

| | | | | |
|---|---|---|---|---|
| 3,943,949 | A | 3/1976 | Anderson et al. | |
| 4,388,933 | A | 6/1983 | Rainer et al. | |
| 5,025,812 | A * | 6/1991 | Fagg | A24B 15/24 131/297 |
| 5,099,864 | A | 3/1992 | Young et al. | |
| 5,144,967 | A | 9/1992 | Cartwright et al. | |
| 5,549,906 | A | 8/1996 | Santus | |
| 5,598,868 | A | 2/1997 | Jakob et al. | |
| 5,783,207 | A | 7/1998 | Stanley et al. | |
| 5,908,033 | A | 6/1999 | Korte, Sr. et al. | |
| 2003/0070687 | A1 * | 4/2003 | Atchley | A24B 13/00 131/352 |
| 2003/0159702 | A1 | 8/2003 | Lindell | |
| 2004/0173228 | A1 * | 9/2004 | Coleman, III | A24B 15/22 131/347 |
| 2005/0167536 | A1 | 8/2005 | Chojnacki | |
| 2008/0029117 | A1 * | 2/2008 | Mua | A24B 13/00 131/352 |
| 2009/0025739 | A1 | 1/2009 | Brinkley et al. | |
| 2011/0139164 | A1 * | 6/2011 | Mua | A24B 3/14 131/111 |
| 2011/0315154 | A1 | 12/2011 | Mua et al. | |
| 2012/0006342 | A1 | 1/2012 | Rose et al. | |
| 2012/0073588 | A1 * | 3/2012 | Kawata | A24B 13/00 131/352 |
| 2012/0125354 | A1 | 5/2012 | Byrd et al. | |
| 2013/0008458 | A1 | 1/2013 | Okada | |
| 2015/0189912 | A1 | 7/2015 | Bell et al. | |
| 2015/0366262 | A1 | 12/2015 | Woodman et al. | |

FOREIGN PATENT DOCUMENTS

| | | | | |
|---|---|---|---|---|
| CN | 85104074 | A | 11/1986 | |
| CN | 86103434 | A | 11/1986 | |
| CN | 86102917 | A | 11/1987 | |
| CN | 1049275 | A | 2/1991 | |
| CN | 102499466 | A | 6/2012 | |
| CN | 103005668 | | 4/2013 | |
| DE | 618359 | C * | 9/1935 | A24B 15/243 |
| EP | 2526787 | | 11/2012 | |
| EP | 2554059 | A1 | 2/2013 | |
| JP | 2013-153755 | | 8/2013 | |
| RU | 2403831 | | 11/2010 | |
| RU | 2403833 | | 11/2010 | |
| RU | 2443131 | | 2/2012 | |
| WO | WO 86/02528 | A1 | 5/1986 | |
| WO | WO 03/099044 | A1 | 12/2003 | |
| WO | WO 2004/008888 | A1 | 1/2004 | |
| WO | WO2009015142 | | 1/2009 | |
| WO | WO 2010/170613 | A1 | 9/2010 | |
| WO | WO 2013/146952 | A1 | 10/2013 | |

OTHER PUBLICATIONS

Sodium Hydroxide MSDS (Material Safety Data Sheet, Sodium Hydroxide Solution 5.0 N, Hach Company, www.nurnberg.com/images/245032-%20msds.pdf, Published Oct. 15, 2009).*
Machine Translation of DE 618359 (Year: 1935).*
Machine Translation of BE 859294 (Year: 1978).*
Definition of Solution, Merriam Webster Dictionary, https://www.merriam-webster.com/dictionary/solution (Year: 2019).*
PCT International Search Report for PCT/GB2014/052548, dated Nov. 11, 2014, 3 pages.
PCT Written Opinion of the International Searching Authority for PCT/GB2014/052548, dated Nov. 11, 2014, 6 pages.
PCT International Preliminary Report on Patentability for PCT/GB2014/052548, dated Jul. 28, 2015, 16 pages.
Application and File History for U.S. Appl. No. 14/765,282, filed Jul. 31, 2015, inventors Woodman et al.
International Search Report and Written Opinion for International Application No. PCT/GB2014/050263 dated May 9, 2014.
Written Opinion of the IPEA for International Application No. PCT/GB2014/050263 dated Feb. 24, 2015.
International Preliminary Report on Patentability for International Application No. PCT/GB2014/050263 dated May 26, 2015.
Chinese Office Action, Application No. 201480051506.3, dated Jul. 4, 2017, 16 pages (25 pages with translation).
Chinese Office Action, Application No. 201480008842, dated Feb. 11, 2018, 6 pages (13 pages with translation).

* cited by examiner

TREATED TOBACCO AND PROCESSES FOR PREPARING THE SAME, DEVICES INCLUDING THE SAME AND USES THEREOF

RELATED APPLICATIONS

The present application is a National Phase entry of PCT Application No. PCT/GB2014/052548, filed Aug. 20, 2014, which claims priority from GB Patent Application No. 1314917.4, filed Aug. 21, 2013, said applications being hereby incorporated by reference herein in their entirety.

TECHNICAL FIELD

Embodiments relate to treated tobacco material and to a process for treating tobacco material to increase its pH. Embodiments also relate to the use of the treated tobacco, for example in a smokeless inhalation device, as well as to devices including the treated tobacco.

BACKGROUND

Smoking articles such as cigarettes and cigars burn tobacco during use to create tobacco smoke. Attempts have been made to provide alternatives to these smoking articles by creating products which release compounds without creating tobacco smoke. Examples of such products are so-called heat-not-burn products which release compounds by heating, but not burning, tobacco.

SUMMARY

According to a first aspect of embodiments, treated tobacco material is provided having a pH of at least about 9 and a moisture content of no more than about 20% based on the dry weight of the tobacco.

In some embodiments, the particle size of the tobacco material is from about 1 to about 3 mm or from about 1 to about 2 mm.

In some embodiments, the tobacco material is ground tobacco.

In some embodiments, the moisture content of the treated tobacco material is from about 5 to about 20%, from about 8 to about 18% or from about 10 to about 15%, based on the dry weight of the tobacco.

According to a second aspect of embodiments, a process is provided for treating tobacco material to increase its pH to at least about 9, the process comprising applying a basic solution to the tobacco material to be treated, and drying the material to produce a treated tobacco material with a moisture content of no more than about 20%.

In some embodiments, the process comprises reducing the particle size of the tobacco material down to a size of from about 1 to about 3 mm, or from about 1 to about 2 mm.

In some embodiments, the particle size of the tobacco material is reduced before applying a basic solution to the tobacco material.

In some embodiments, the tobacco is sliced prior to the application of the basic solution, and the tobacco particle size is further reduced down to a size of from about 1 to about 3 mm, or to a size of from about 1 to about 2 mm, following application of the basic solution.

In some embodiments, the basic solution comprises a base selected from the group consisting of: sodium carbonate, sodium hydroxide and sodium phosphate. In some embodiments, the basic solution comprises sodium hydroxide. In some embodiments, the sodium hydroxide solution has a concentration in the range of about 3.0 to about 9.0 Mol/L.

In some embodiments, the treated tobacco material is dried to have a moisture content of from about 5 to about 20%, from about 8 to about 18%, or from about 10 to about 15%, based on the dry weight of the tobacco.

In some embodiments, the tobacco starting material is baled leaf.

In some embodiments, the tobacco is not exposed to a temperature above about 65° C., above about 60° C., above about 55° C., or above about 50° C. during the treatment process.

According to a third aspect of embodiments, a smokeless inhalation device is provided, comprising a tobacco material according to the first aspect or comprising a treated tobacco material prepared by a process according to the second aspect.

In some embodiments, the treated tobacco material in the device is heated to volatilize nicotine.

In some embodiments, the treated tobacco material is heated to a temperature of no higher than about 80° C., no higher than about 75° C., no higher than about 70° C., no higher than about 65° C., no higher than about 60° C., or no higher than about 55° C. to produce nicotine in an inhalable form.

In some embodiments, the device provides a dose of inhalable nicotine of no less than about 0.01 mg per gram of tobacco and of no more than about 0.3 mg per gram of tobacco based on the ISO smoking regime.

According to a fourth aspect of embodiments, there is provided a use of a treated tobacco material according to the first aspect or of a treated tobacco material prepared by a process according to the second aspect to provide nicotine in an inhalable form upon heating the treated tobacco to a temperature of less than about 100° C.

In some embodiments, the use of the treated tobacco material provides a dose of nicotine in inhalable form of no less than about 0.01 mg and of no more than about 0.3 mg per gram of tobacco based on the ISO smoking regime.

BRIEF DESCRIPTION OF DRAWINGS

For the purposes of example only, embodiments are described below with reference to the accompanying drawings, in which.

DETAILED DESCRIPTION

Figure 1:
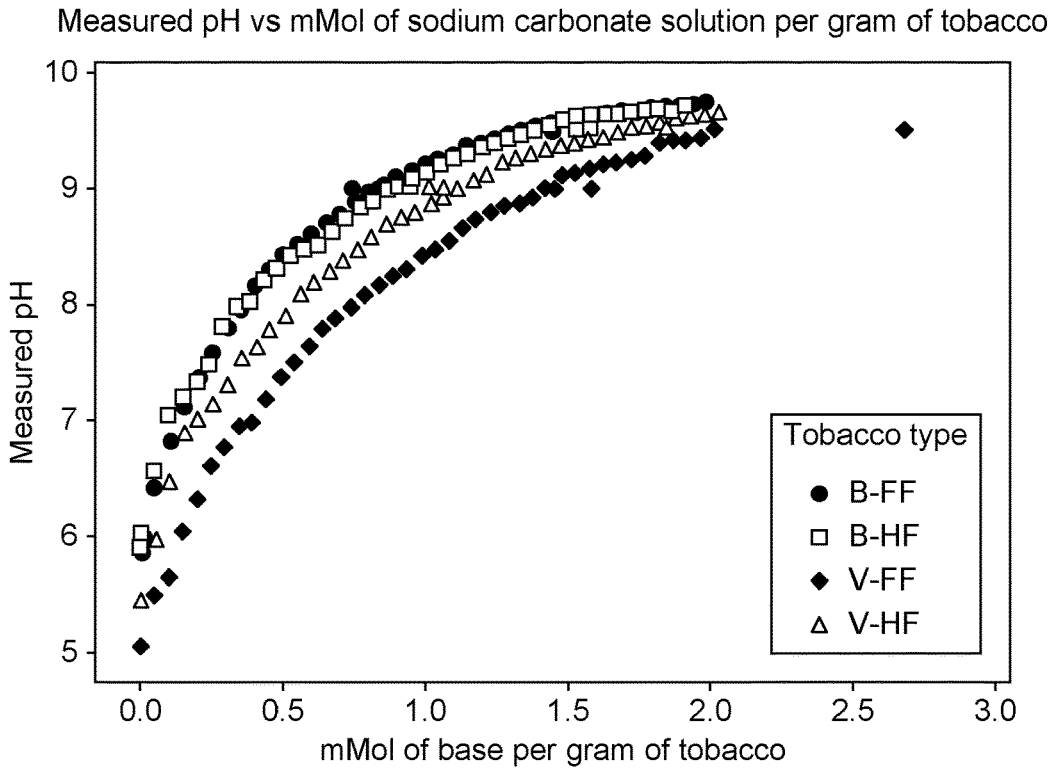
FIG. 1 is a graph showing the effect on pH of adding sodium carbonate solution to different tobacco materials.

In embodiments, the treatment of the tobacco material involves an increase in the pH of the tobacco material. The normal, unadjusted pH of cured tobacco material depends upon the type of tobacco, but it is generally slightly acidic, usually within the range of 4.5-6.5 and frequently approximately 5. Raising the tobacco to a basic pH (>7) will result in more of the nicotine present in the tobacco being in the form of nicotine free base. This form of nicotine is more readily released upon heating the tobacco.

In some smokeless inhalation devices, tobacco material may be heated but not combusted (so-called heat-not-burn devices). In such devices it is important that the tobacco material releases desired components at the relatively low temperature to which the tobacco material is heated. The components which are released by heating are volatilized at the temperatures in question, so that they may be inhaled by the user.

The tobacco components to be volatilized include flavors and nicotine. These components may be inherently present in the tobacco material or they may be added to the tobacco material. In addition, the tobacco material may be treated to enhance release of the components.

By increasing the pH of the tobacco material by processes described herein, nicotine may be released at lower temperatures. When such treated tobacco is included in a device where the tobacco is heated but not combusted (a so-called heat-not-burn device), it is possible to release some nicotine from the tobacco material despite the relatively low temperature it is exposed to. In some devices, the tobacco is heated to less than 100° C., less than 90° C., less than 80° C., less than 70° C., less than 60° C. or even to less than 55° C. At these lower temperatures, very little measurable nicotine would be released from conventional tobacco.

In some embodiments, adjusting the pH of the tobacco will increase the levels of nicotine and flavors released when the temperature of the heating device is shifted from approximately 100-150° C. to approximately 50-95° C.

The pH adjustment of tobacco is also understood to be important for the final sensory quality of the heated smoking article due to its effect on nicotine availability.

In some embodiments, the treatment process comprises applying a basic solution to the tobacco material to be treated. The mixture of the tobacco material and the basic solution is then agitated. In some embodiments, the agitation is achieved by mixing the mixture or by moving the tobacco material. This may increase the contact between the base and the tobacco. During or following the agitation of the mixture, ammonia gas which is generated by the treatment of the tobacco with a basic solution may be removed.

It has been discovered that ammonia is released due to the pH being increased This ammonia may be removed. In some embodiments, the processes described herein therefore include a step or task of ammonia removal.

The application of the basic solution brings the tobacco material into contact with the base in the basic solution and agitation may further increase this contact. Following contact with the tobacco at least some of the base is expected to be neutralized by buffering compounds which are inherently present in the tobacco. Depending on the pH response of tobacco, residual free base could be present. In some embodiments, this residual base is removed, whilst in other embodiments it remains present on the tobacco material.

In some embodiments, the process may be used to adjust the pH to within the range of 8.5-12, from 9-11. In other embodiments, the process may be used to adjust the pH to above 9, above 9.5, above 10 or above 10.5. In some embodiments, the process may be used to adjust the pH to no higher than 12, no higher than 11.5 or no higher than 11.

Tobacco Starting Material

The tobacco material to be treated using the process may be any type or grade of tobacco. As used herein, the term "tobacco material" includes any part, such as for example the leaves or stems, of any member of the genus *Nicotiana* and reconstituted materials thereof. The tobacco material for use in embodiments may be from the species *Nicotiana tabacum*.

The tobacco material may be from one variety of tobacco. Alternatively, the tobacco material may be from more than one variety of tobacco. In other words, the tobacco material may comprise a blend of tobacco varieties. The tobacco material may comprise tobacco of a certain quality. For example, the tobacco material may comprise tobacco of high, medium and/or low quality. In some embodiments, the tobacco material comprises tobacco of medium and/or low quality.

The nicotine content of tobacco material varies and is generally between 0.2% and 7%. In some embodiments, the treated tobacco material is prepared using a tobacco variety or a blend of tobacco varieties with a relatively high nicotine content. For example, the tobacco starting material may have a nicotine content of between 0.2% and 7%. In other embodiments, the treated tobacco material is prepared using a tobacco variety or a blend of tobacco varieties with a relatively low nicotine content. For example, the tobacco starting material may have a nicotine content of between 0.2% and 4%.

Any type of tobacco can be used to prepare the treated tobacco described herein. Examples of tobacco which can be treated include but are not limited to Virginia, Burley, Oriental and Rustica tobaccos. The tobacco material may be pre-treated according to known practices, such as drying, curing, and so on before being treated to adjust the pH and the moisture content.

In some embodiments, the tobacco starting material comprises lamina tobacco material. The tobacco material may comprise up to 50%, up to 60%, up to 70%, up to 80%, up to 90%, or up to 100% lamina tobacco material.

Treated Tobacco Material

In some embodiments, the treated tobacco material has a pH of at least about 9. In some embodiments, it has a pH of at least 9.5 or at least about 10. In some embodiments, the treated tobacco material has a pH of no more than about 12, or no more than about 11.5, no more than about 11, no more than about 10.5 or no more than about 10. In some embodiments, the treated tobacco material has a pH of about 9.5 or a pH of about 10.

In some embodiments, the treated tobacco material has a moisture content of no more than 20% based on the dry weight of the tobacco. In some embodiments, the treated tobacco material has a moisture content of no more than 15% or of on more than 14%. In some embodiments, the treated tobacco material has a moisture content of less than 20% or less than 15%. These moisture contents mean that the treated tobacco material is suitable for use in a smokeless inhalation device, such as a heat not burn device.

In some embodiments, the treated tobacco material has a moisture content of no more than about 20%, 19%, 18%, 17%, 16%, 15%, 14%, 13%, 12%, 11% or no more than about 10%. In some embodiments, the treated tobacco material has a moisture content of at least about 5%, 6%, 7%, 8%, 9%, 10%, 11%, 12%, 13%, 14, or at least about 15%. In some embodiments, the treated tobacco material has a moisture content from about 5 to about 20%, from about 8 to about 18% or from about 10 to about 15% based on the dry weight of the tobacco. Herein, the moisture content is given as the weight percent based upon the dry weight of the tobacco.

The various FIGS. and ranges disclosed herein for moisture content of the treated tobacco represent target levels of moisture content and, in some embodiments, these represent the moisture content of the majority of the treated tobacco material. However, it should be recognized that tobacco is a natural and inherently variable product and the measured levels of moisture of samples of a treated tobacco can be variable and are sometimes higher or lower than the stated levels or ranges. Despite such minor variations, the treated tobacco is considered to fall within the scope of the claims where at least one sample has a moisture content falling within the recited range.

In some embodiments, the treated tobacco material has a particle size of from about 1 to about 3 mm or from about 1 to about 2 mm. In some embodiments, the treated tobacco material has a particle size greater than 1 mm.

In some embodiments, the particle size of the treated tobacco material may be reduced by any suitable method. In some embodiments, the treated tobacco material is ground tobacco.

Devices

The treated tobacco material described herein may be incorporated into a device. In some embodiments, the device is a smokeless inhalation device.

In some embodiments, the device includes a heat source which emits heat upon use, for example, upon actuation of the apparatus by the user. Various different types of heat source may be used, optionally including an electric heat source or a chemical heat source, such as an exothermic chemical reaction or an exothermic phase change. In some embodiments, the heat source heats to a peak temperature of from about 40 to about 60° C., or from about 45 to about 55° C.

Figure 10:
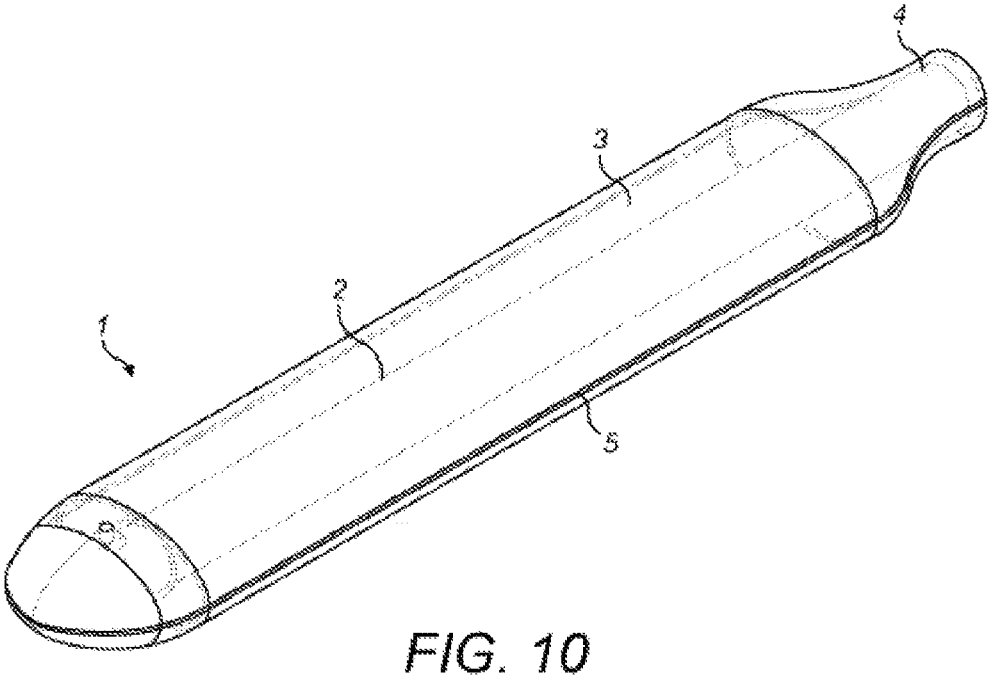
FIG. 10 is a schematic illustration of an inhalation device including a heat source and a treated tobacco material according to embodiments.

In some embodiments, as illustrated in FIG. 10, such an inhalation device (1) comprises a housing (5) within which the heat source material (3) is held in a heat source chamber, and a treated tobacco material (2) is held in a separate heating chamber, the heat source chamber and the heating chamber being arranged to allow transfer of heat from the heat source chamber to the treated tobacco material, so that at least some of the nicotine in the treated tobacco material may be volatilized. In some embodiments, the inhalation device additionally includes a mouthpiece (4) through which the volatilized nicotine (and optionally other volatilized components of the treated tobacco) may be inhaled.

In some embodiments, it may be desirable for treated tobacco to provide a dose of inhalable nicotine in the range of 0.01 mg per gram of tobacco to 0.3 mg per gram of tobacco based on the ISO smoking regime upon heating to a temperature in the range of from about 35° C. to less than about 80° C., for example as may be done when the treated tobacco is included in a smokeless inhalation device. This dose of inhalable nicotine may contribute to achieving an acceptable sensory result upon use of the smokeless inhalation device which heats the tobacco rather than combusts it. In some embodiments, this dose of inhalable nicotine may be provided when the treated tobacco is heated to a temperature in the range of from about 35, 40, 45, 50 or 55° C. to about 80, 75, 70, 65, 60 or 55° C.

The ISO smoking regime involves a 35 $cm^3$ puff of 2 second duration every 60 seconds.

In some embodiments, the treated tobacco provides a dose of inhalable nicotine of at least about 0.01, 0.015, 0.02, 0.025 or at least about 0.03 mg per gram of tobacco based on the ISO smoking regime upon heating to a temperature in the range of from about 35 to less than about 80° C. In some embodiments, the treated tobacco provides a dose of inhalable nicotine of no more than about 0.3, 0.25, 0.2, 0.15, 0.1 or no more than about 0.05 mg per gram of tobacco based on the ISO smoking regime upon heating to a temperature in the range of from about 35 to less than about 80° C.

In some embodiments, a device containing from about 300 to about 450 mg of treated tobacco and being heated to a temperature between 35 and 80° C. provides inhalable nicotine in an amount of between 0.01 mg and 0.1 mg based on the ISO smoking regime.

Uses

The pH adjusted tobacco materials described herein may be used to release nicotine in inhalable form when the tobacco material is heated to temperatures below 100° C.

Indeed, in some embodiments, the treated tobacco materials described herein may be used to provide nicotine in an inhalable form upon heating the treated tobacco to a temperature of less than 80° C., or of no more than 80° C., 75° C., 70° C., 65° C. or of no more than 55° C.

In some embodiments, the treated tobacco is used to provide a dose of inhalable nicotine of at least about 0.01, 0.015, 0.02, 0.025 or at least about 0.03 mg per gram of tobacco based on the ISO smoking regime upon heating to a temperature in the range of from about 35 to less than about 80° C. In some embodiments, the treated tobacco is used to provide a dose of inhalable nicotine of no more than about 0.3, 0.25, 0.2, 0.15, 0.1 or no more than about 0.05 mg per gram of tobacco based on the ISO smoking regime upon heating to a temperature in the range of from about 35 to less than about 80° C.

In some embodiments, the nicotine in inhalable form is produced, upon heating the treated tobacco material, in an amount of at least about 0.01 mg and of no more than about 0.3 mg per gram of tobacco based on the ISO smoking regime.

Processes for Preparing Treated Tobacco Material

The treated tobacco material may be prepared using a variety of processes in order to increase its pH to at least 9 and to adjust the moisture content to the desired level.

In some embodiments, the process comprises applying a basic solution to the tobacco material to be treated, and drying the material to produce a treated tobacco material with a moisture content of no more than 20%.

Basic Solution

In some embodiments, the pH of the treated tobacco is adjusted by exposing the tobacco to a base. In some embodiments, the resultant pH of the treated tobacco may dependent upon: (i) the base used to prepare the basic solution; (ii) the concentration of the basic solution; (iii) the extent of the exposure of the surface of the tobacco material to the basic solution; (iv) the duration of the exposure of the tobacco material to the basic solution; (v) the starting pH of the tobacco material; (vi) any buffering compounds naturally present in the tobacco material; (vii) the starting moisture content of the tobacco material; (iix) the particle size and morphology of the tobacco material; and (ix) the tobacco type.

In some embodiments, the basic solution is selected to adjust the pH of the tobacco to a desired target range. In some embodiments, it may also be desirable to adjust the pH of the tobacco using only a small volume of basic solution, so that the moisture content of the tobacco is not significantly increased by the addition of the basic solution. Using a smaller volume of basic solution to adjust the pH of the tobacco may reduce or may even remove the need to dry the tobacco after the application of the basic solution. In some embodiments, a base is selected that is a strong base and has a high water solubility to allow use of higher concentration solutions and therefore smaller volumes of solution.

The addition of large volumes of basic solution to the tobacco material to be treated means that there is more solution which needs to be removed once the step or task has been completed. This can involve the use of large amounts of energy and/or time, and can require the treated tobacco to be exposed to conditions such as temperatures that may affect chemical and/or physical properties of the treated tobacco.

Therefore, in some embodiments, the pH treatment step or task involves the addition of as small a volume of basic solution as possible. In order to compensate for the low volumes used, in some embodiments a stronger base is used or a longer exposure period or both.

In some embodiments, the basic solution is an aqueous solution. In some embodiments, the basic solution has a concentration of from about 3 to about 10 Mol/L, or from about 6 to about 9 Mol/L.

In some embodiments, the basic solution comprises an aqueous sodium carbonate solution ($Na_2CO_3$). In some embodiments, the concentration of the $Na_2CO_3$ solution is from about 6 to about 9 Mol/L, from about 7 to about 9, or from about 8 to about 9 Mol/L.

Other suitable bases include sodium hydroxide (NaOH) or sodium phosphate. In some embodiments, the concentration of the aqueous NaOH solution is from about 5 to about 9 Mol/L, from about 6 to about 8, or from about 6 to about 7 Mol/L.

Figure 2:
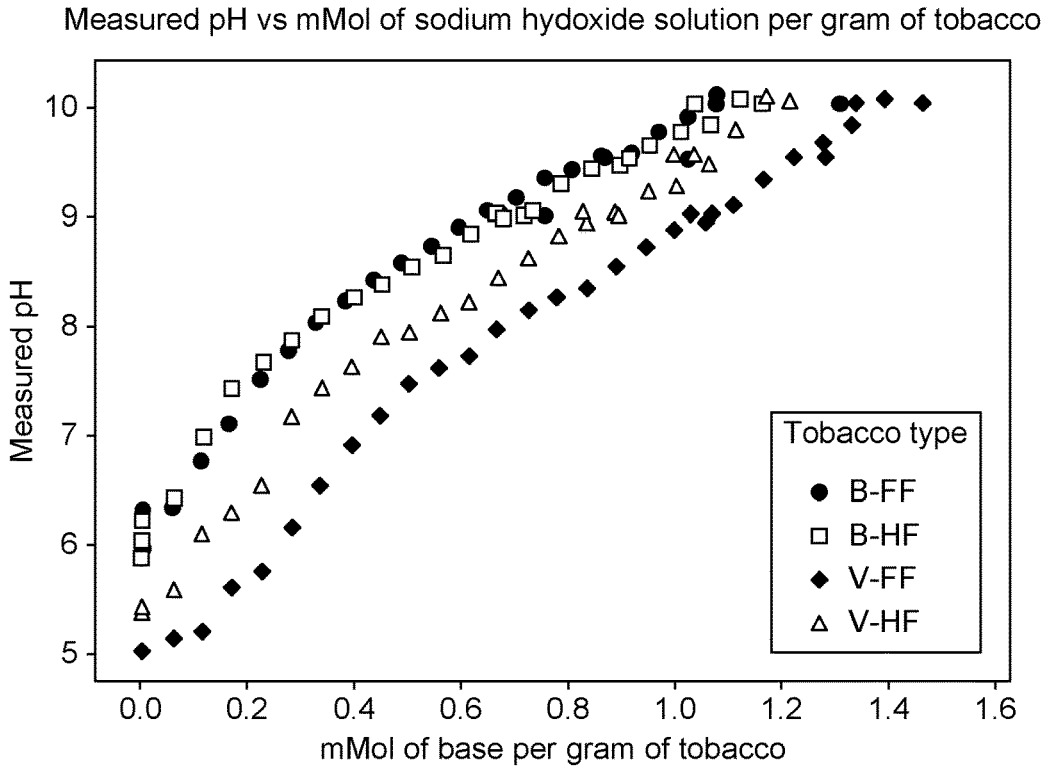
FIG. 2 is a graph showing the effect on pH of adding sodium hydroxide solution to different tobacco materials.
Figure 3:
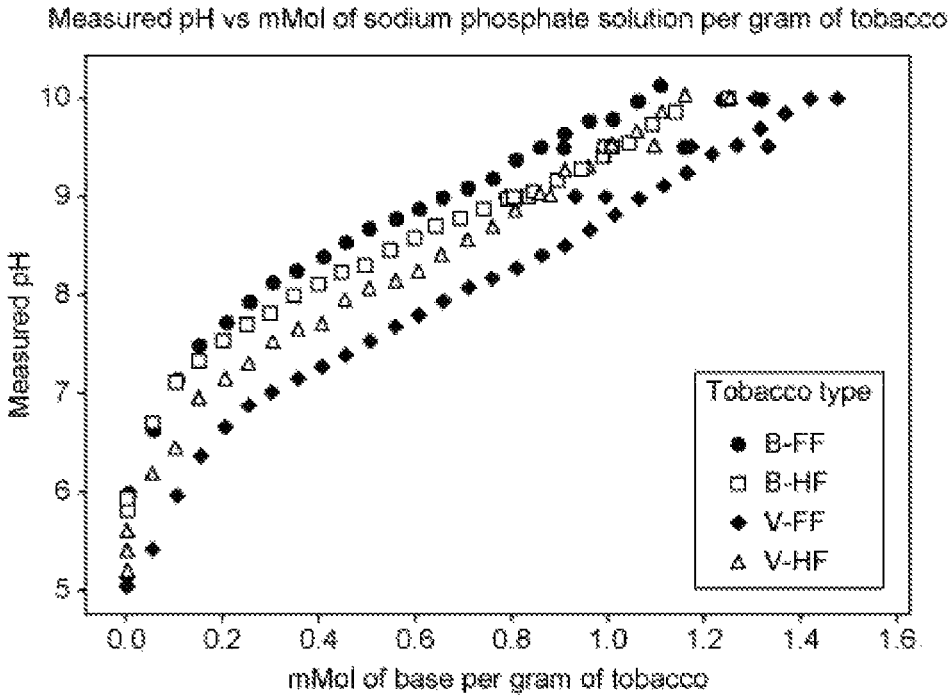
FIG. 3 is a graph showing the effect on pH of adding sodium phosphate solution to different tobacco materials.

Experiments were carried out to investigate the quantity of stronger bases required to raise the pH of four tobacco grades to the correct level, namely two grades of Burley tobacco and two grades of Virginia tobacco. For each base the measured pH was plotted against the amount of basic solution added to the tobacco (mMol/gram tobacco) and the resultant graphs are shown in FIGS. 1 to 3. This data shows that although the four tobacco grades have different starting pHs, with the untreated Virginia grades having a lower pH than the Burley grades, the increase in pH for the different grades of tobacco as base is added appears to follow the same curve.

The three bases, sodium carbonate, hydroxide and phosphate, however, exhibit different curves when the pH is plotted against the amount of base added. Sodium carbonate shows a plateauing effect as the pH reaches the required level (see FIG. 1), whereas sodium hydroxide and sodium phosphate do not (see FIGS. 2 and 3).

In some embodiments, the base used in the basic solution is sodium hydroxide. This base may be preferred in certain circumstances as a smaller volume of this basic solution would be required to reach the required pH and therefore less drying would be required following pH treatment.

In some embodiments, the basic solution is applied to the tobacco by spraying the solution onto the tobacco material. In some embodiments, the tobacco may be arranged to increase the exposed surface area, for example by spreading the tobacco out over a large area. This will ensure that the basic solution is evenly distributed over the tobacco material.

Agitation

In some embodiments, the tobacco material may be mixed or agitated during or after application of the basic solution. This mixing or agitation may assist the even distribution of the basic solution over the surface of the tobacco material, which may enhance uniform adjustment of the pH of the tobacco material.

In some embodiments, the agitation of the mixture of tobacco and basic solution may involve stirring and/or tumbling the mixture.

In some embodiments, all of the basic solution is applied to the tobacco and then the mixture is mixed. In other embodiments, a portion of the basic solution is applied to the tobacco and the mixture is mixed before adding a further portion of the basic solution and then further mixing the mixture. This may be repeated until all of the basic solution has been added. The basic solution may be divided into 2 or more portions. The portions may be of roughly equal volume or they may be different volumes.

Drying

As the addition of the basic solution involves the addition of water to the tobacco material, in some embodiments it may be necessary or appropriate to dry the basic solution-treated tobacco, to ensure that the tobacco has an acceptable moisture content for its proposed use.

The drying the tobacco material following the application of the basic solution, and the removal of ammonia, may be carried out simultaneously or consecutively. In some embodiments, it may be beneficial that the process is designed to require as little drying as possible, and that the steps or tasks of the process are carried out under conditions which result in as little loss of nicotine as possible. Thus, for example, it may be desirable to expose the tobacco to elevated temperatures and/or reduced pressure as little as possible. In some embodiments, the process includes a drying step or task following application of the basic solution. This drying step or task may, in some embodiments, involve removal of the liquid which is used to adjust the pH.

In some embodiments, the drying step or task involves exposing the tobacco to a flow of air. In some embodiments, the drying step or task is carried out at ambient temperature (i.e. from about 20° C. to about 25° C.). In some alternative embodiments, the drying step or task may involve gentle warming. In order to minimize the loss of volatiles, heating of the wet tobacco may be limited. In some embodiments, the wet tobacco is warmed at from about 65° C. to about 85° C. (as opposed to the tobacco material being warmed to this temperature range). This warming temperature is significantly lower than the temperatures at which conventional cut rag tobacco is dried, which is generally done at 200° C. or higher.

The tobacco material may be dried before application of the basic solution. This can reduce the need to dry the tobacco material after treatment with the base. In some embodiments, the tobacco material is dried to reduce its moisture content to 5 to 10%. The preferred moisture content prior to application of the basic solution is 10-14%.

Reducing Particle Size

The form of the tobacco material at the start of the process (also referred to herein as the tobacco starting material) may be cut-rag, ground tobacco or baled leaf.

In some embodiments, the tobacco starting material may be provided in a form that has the desired particle size. This means that the treatment process does not need to include a step or task whereby the particle size of the tobacco material is reduced, for example by chopping, grinding or milling, after which the desired particle size is selected.

In some embodiments, the tobacco starting material is a ground tobacco. In alternative embodiments, the process includes the step or task of grinding or otherwise reducing the particle size of the tobacco starting material and then optionally selecting particles of the desired size range.

In some embodiments, one of the steps or tasks of the process involves the treatment of the tobacco material to reduce the particle size of the tobacco. In some embodiments, the tobacco is chopped, ground or milled. The resultant particles of tobacco may then be sorted to select those particles with the desired particle size. This selection may be carried out using sieving, with sieves defining the upper and lower limits of the desired particle size range.

In some embodiments, an advantageous particle size may be from about 1 mm to about 3 mm, or from about 1 mm to about 2 mm. The particles in these size ranges may be classified by sieving. The particle size distribution may be measured by dynamic imaging analysis. For particles with sizes between 1 and 2 mm, the measurements may be $X_c$min<2.0 mm for at least 90% of the particles and $X_{Length}$ being <2.0 mm for at least 50% of the particles.

In some embodiments, the average particle size of the tobacco is selected to be 1-3 mm. In some embodiments, this particle size may be measured by sieving using a sieve with a mesh size of 1 mm and a sieve with a mesh size of 3 mm.

Conditioning

In some embodiments, the treatment process includes a conditioning step or task in which moisture and/or casing (liquid conditioning agents) is added. Where the treatment process further includes a step or task in which the form and/or size of the tobacco material is adjusted, the conditioning step or task may be carried out before or after this step or task.

In some embodiments where the tobacco starting material is ground tobacco, the tobacco is not conditioned before grinding. It may not be necessary to add casing. Water is added during the treatment process, as a result of the need for water to carry the base used to adjust the pH of the tobacco. As a result, the treatment process may already involve the addition of excess water and so no additional water needs to be added in a separate conditioning step or task. However, in some embodiments, a conditioning step or task may be carried out before a grinding step to produce a conditioned ground tobacco starting material. The conditioning agents may improve the grinding process or it may provide the ground tobacco material with properties which are desirable in the tobacco end product or which enhance the treatment process.

Sequence of Steps or Tasks

Various sequences of steps or tasks may be used in order to achieve the desired pH adjustment of the tobacco material in accordance with the treatment process of embodiments. Selected possible sequences of operations are set out below, as illustrated in the diagrams of FIGS. 4 to 10.

Figure 4:
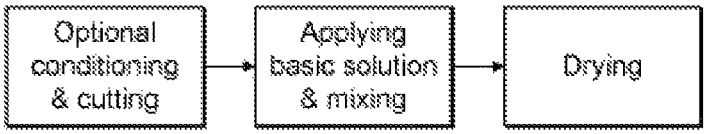
FIGS. 4 to 9 are flow charts showing different sequences of processes according to various embodiments.

Sequence 1 is illustrated in FIG. 4. The tobacco starting material is provided and a basic solution is applied to the tobacco, for example by spraying the solution onto the tobacco material. In some embodiments, the tobacco starting material may be provided having already been conditioned, for example being in the form of cut rag or conditioned lamina strips. Following application of the basic solution, the mixture of tobacco and basic solution is mixed to spread the solution evenly over the surface of the tobacco material. In some embodiments, the application of basic solution and mixing may be repeated. Finally in Sequence 1, following the mixing step or task, the wet tobacco material is dried to reduce the moisture content to the desired target level. In addition, this step or task may also result in the purging of at least some of the volatile ammonia which has been generated as a result of the pH adjustment of the tobacco.

Figure 5:
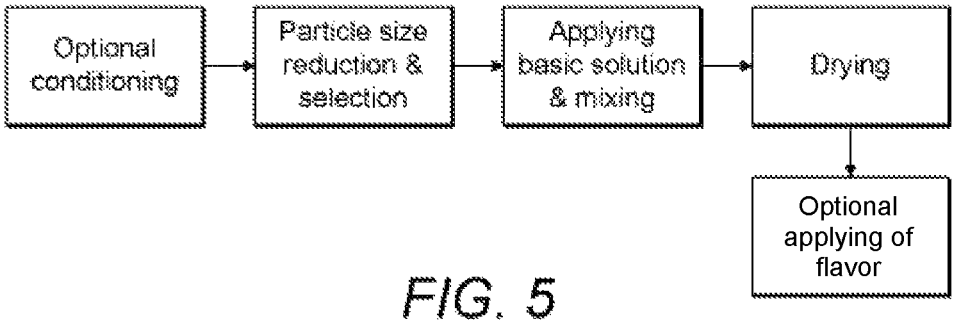

Sequence 2 is illustrated in FIG. 5. Here the conditioning of the starting tobacco material may be carried out as part of the treatment process. In some alternative embodiments, the starting material may be provided having already been conditioned, for example being in the form of conditioned lamina strips or cut rag. Next, the tobacco starting material is treated to obtain the desired the particle size. This may be done by grinding and then optionally selecting the particles with a size within the desired particle size range, for example by sieving. Next, the basic solution is applied to the tobacco, for example by spraying the solution onto the tobacco material. Then the mixture of tobacco and basic solution is mixed, for example as described above in connection with Sequence 1. The wet tobacco material is then dried to obtain the desired moisture level. This drying step or task may also involve removal of at least some of the volatile ammonia generated by increasing the pH of the tobacco. In a final optional step or task, flavor may be added to the dried treated tobacco. For example, flavor may be sprayed onto the tobacco. If this addition of flavor increases the moisture content of the tobacco, the drying step or task may need to be adapted to ensure that the final product has the desired moisture content.

Figure 6:
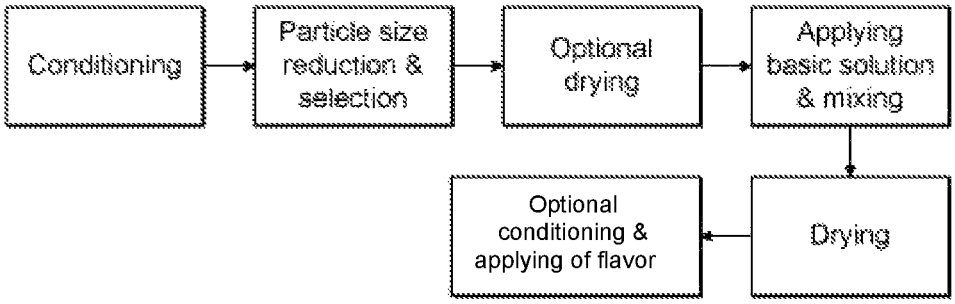

Sequence 3 is illustrated in FIG. 6. The tobacco is fed into a conditioning or direct conditioning and casing cylinder (DCC or DCCC) where the tobacco is conditioned and casing may be added. The moisture content of the tobacco material may be raised to over 20% whilst in the conditioning cylinder. The conditioned tobacco material may then be cut to produce cut rag or ground to required particle size. Next in this embodiment, there may be an optional drying step or task. Next, the pH of the tobacco is adjusted by the addition of the base. As this step or task also involves the addition of water, the moisture content will increase once again. The moisture in the tobacco is then reduced in a step or task which combines the removal of water with the purging of ammonia. In some embodiments, the purge/dry step or task takes the moisture content back down to in the region of about 12-14%. A further conditioning step or task may be included, to adjust the properties of the pH adjusted tobacco material should the purge/dry step or task reduces the moisture level below 12%. In some embodiments, the pH of the resultant tobacco material is in the region of about 9-11 and the final moisture content is in the region of about 12-14%. In some embodiments, an optional flavoring step or task can be carried out and drying and either before or after the final optional conditioning step or task.

Figure 7:
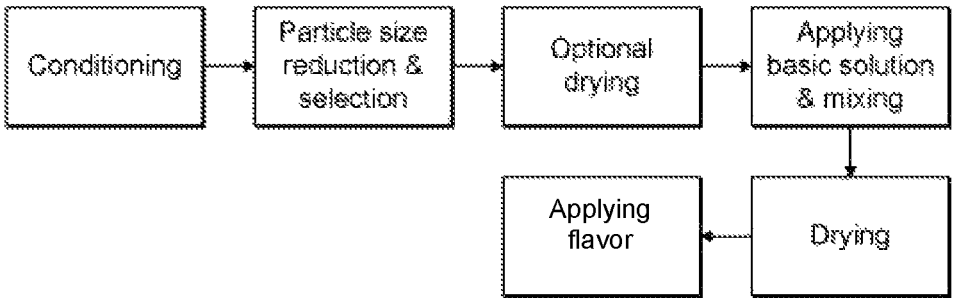

Sequence 4 is illustrated in FIG. 7. It is an adaption of Sequence 1 discussed above. The later conditioning step has been eliminated and a flavoring step or task has been added. A size reduction step or task is introduced upstream of the pH adjustment. Reducing the size of the tobacco before the pH adjustment step or task means that one does not condition and treat material which is later lost as a result of the size reduction. Size reduction frequently results in a significant proportion of the material being lost, for example because it is not of the desired particle size. In the case of grinding, some of the ground tobacco will be too small to use and the fine material may well also need to be discarded. Carrying out the pH treatment after size reduction may mean that the material is more suited to conventional tobacco equipment and there may be greater surface area for heat and mass transfer. Attrition from particle size reduction may also be lower because the pH treated material is likely to be more brittle. Conditioning may improve attrition from particle size reduction but to make later drying after pH adjustment easier, it is possible to include an optional drying step or task before the pH treatment.

Figure 8:
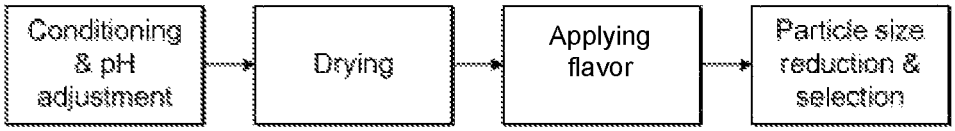

Sequence 5 is illustrated in FIG. 8. Sequence 5 combines conditioning and pH adjustment as both steps or tasks require the addition of water. Unlike Sequence 3 this has only one drying step or task; it rationalizes the moisture manipulation through the process. This scheme has size reduction after the pH adjustment.

Figure 9:
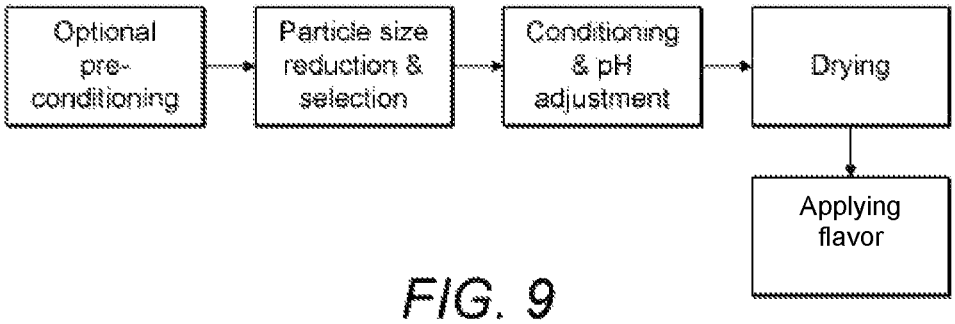

Sequence 6 is illustrated in FIG. 9. Sequence 6 is similar to Sequence 5 but has size reduction upstream of pH adjustment.

In general, sequences with a small number of steps or tasks is expected to provide benefits in terms of cost, time and ease of implementation.

In some embodiments, an advantageous feed stock is baled, cured leaf. In some embodiments, casing is not required.

Experiment 1

The following describes the laboratory process to adjust the pH of tobacco using an aqueous sodium carbonate basic solution.

Approximately 200 g of tobacco wet-weight basis (WWB) was dried overnight at 24° C. to 30° C. in a laboratory oven. Once dry, the moisture of the tobacco was measured and recorded using a Mettler-Toledo Moisture Analyzer. The mass of the dry tobacco (WWB) required to provide 160 g dry-weight basis (DWB) tobacco was calculated as follows:

$$DWB\ tobacco = WWB\ tobacco * \left(\frac{[100 - \text{moisture}]}{100}\right)$$

The basic solution was prepared comprising 30 g of solid sodium carbonate ($Na_2CO_3$) per 100 mL water. In order to prepare 250 mL of this aqueous $Na_2CO_3$ solution, 75 g of $Na_2CO_3$ was weighed, dissolved in de-ionized water and placed into a 250 mL volumetric flask. The volume was then made up with de-ionized water to get the required volume of solution. 50 mL of this $Na_2CO_3$ aqueous solution was added to a spray bottle.

80 g of the dry tobacco (DWB) was placed in a container with an air tight lid (for example a Fisher Scientific clear plastic sample box), and half of the $Na_2CO_3$ aqueous solution (25 mL) was sprayed onto the tobacco. The container containing the tobacco was sealed and was tumbled either by hand (manually turning box over and over) or by placing in a laboratory rotator (for example a Stuart Laboratory Rotator) to mix the contents for a minimum of 1 minute and up to 5 minutes. The container was then reopened and the remaining (25 mL) $Na_2CO_3$ solution was sprayed onto the tobacco. Then the container was resealed and was tumbled for a further 5 minutes to thoroughly mix the contents.

The $Na_2CO_3$ treated tobacco was then transferred into another container suitable for drying, for example a large shallow tray. The container (open) was placed in a fume hood with the air flow on, the fumehood sash closed to leave a gap of approximately 75 mm and left to dry/purge for between 12 to 48 hours. The pH and moisture content were checked and recorded after 12 and then every 24 hours.

Following the drying of the tobacco, it was transferred into an airtight container and stored in a conditioning cabinet at 22° C. and 60% relative humidity (RH). During the first day of the storage, the lid of the container was not tightly fitted but was rather left ajar.

To analyze the tobacco for the nicotine released when the pH adjusted tobacco is heated, the adjusted tobacco is placed into a heating device, which is then attached to a mechanical smoking machine. The attached tobacco-filled heating device is then puffed upon following a set regime, documented as "Puff volume/Puff Duration/Frequency", which is programmed into the mechanical smoking machine. For example the ISO smoking regime is 35 mL puff volume, 2 second puff duration, 60 puff frequency.

Data for blend analysis of typical batches of four different pH adjusted tobaccos and the measured nicotine deliveries for those tobaccos are shown below:

TABLE 1

Blend analysis and nicotine delivery results of four different pH adjusted tobaccos

| Analysis of pH Adjusted Tobacco | | Burley 1 | Burley 2 | Virginia 1 | Virginia 2 |
|---|---|---|---|---|---|
| Nicotine (DWB, %) | Before | 4.14 | 3.04 | 4.03 | 3.70 |
| | After | 2.24 | 2.24 | 2.88 | 2.87 |
| pH | Before | 6.1 | 6.4 | 5.4 | 5.0 |
| | After | 10.3 | 10.1 | 9.8 | 9.8 |
| Nicotine delivery (Mean, ISO regime, mg nicotine per 375 mg tobacco) | | 0.014 | 0.015 | 0.021 | 0.018 |
| Water by Near Infra-Red (NIR, %) | Before | 14.6 | 13.35 | 13.12 | 13.58 |
| | After | 13.82 | 13.80 | 13.57 | 13.56 |
| Ammonia Nitrogen (DWB, mg/g) | Before | 3.59 | 3.85 | 0.58 | 0.51 |
| | After | 0.33 | 0.71 | 0.21 | 0.32 |

Experiment 2

Work was done to understand the amount of base required to adjust the pH of four different tobacco materials to 9.5.

Following the standard laboratory process for pH adjustment (see Experiment 1) three aqueous basic solutions, sodium carbonate, sodium hydroxide and sodium phosphate, were made up to 0.1 mol/mL. The solutions were then titrated into a stirring mixture of tobacco and de-ionized water while the pH was monitored with a probe. The pH was recorded after each subsequent addition of 5 mL of basic solution, these results are shown in FIGS. 1 to 3. The graphs in FIGS. 2 and 3 show that based on these experiments approximately 1.5 mMol of either sodium hydroxide or sodium phosphate would raise the pH of 1 g of the range of tobaccos to the required level or higher.

Following this, repeat experiments were carried out titrating the basic solution into a stirring mixture of tobacco and de-ionized water and recording the volume of solution required for the mixture to reach pH 9.5. Table 2 shows these results for the four tobacco types for sodium carbonate and the calculated mass of sodium carbonate required to raise 1 g of the four different tobaccos to pH 9.5. Tables 3 and 4 show the same results and calculations using sodium hydroxide and sodium phosphate aqueous solutions.

TABLE 2

Amount of sodium carbonate ($Na_2CO_3$) required to raise pH of tobacco/water mixture to 9.5

| | Tobacco | Base required to raise pH to 9.5 | |
|---|---|---|---|
| Sample No. | Type & Mass (g) | Volume (mL) | Mass of base required per gram of tobacco (g) |
| 1 | Virginia 110.033 | 171.2 | 0.182 |
| 2 | Virginia 110.165 | 186.2 | 0.196 |
| 3 | Virginia 210.015 | 200.0 | 0.213 |
| 4 | Virginia 210.004 | 267.0 | 0.285 |
| 5 | Burley 110.594 | 166.0 | 0.167 |

TABLE 2-continued

| Amount of sodium carbonate ($Na_2CO_3$) required to raise pH of tobacco/water mixture to 9.5 | | | |
|---|---|---|---|
| | Tobacco | Base required to raise pH to 9.5 | |
| Sample No. | Type & Mass (g) | Volume (mL) | Mass of base required per gram of tobacco (g) |
| 6 | Burley 110.064 | 151.6 | 0.162 |
| 7 | Burley 210.352 | 137.2 | 0.143 |
| 8 | Burley 210.066 | 143.8 | 0.153 |

TABLE 3

| Amount of sodium hydroxide (NaOH) required to raise pH of tobacco/water mixture to 9.5 | | | |
|---|---|---|---|
| | Tobacco | Base required to raise pH to 9.5 | |
| Sample No. | Type & Mass (g) | Volume (mL) | Mass of base required per gram of tobacco (g) |
| 1 | Virginia 110.030 | 100.0 | 0.041 |
| 2 | Virginia 110.337 | 100.0 | 0.040 |
| 3 | Virginia 210.170 | 128.6 | 0.051 |
| 4 | Virginia 210.062 | 100.0 | 0.041 |
| 5 | Burley 19.921 | 89.4 | 0.036 |
| 6 | Burley 110.252 | 88.0 | 0.036 |
| 7 | Burley 210.131 | 90.8 | 0.041 |
| 8 | Burley 210.712 | 87.0 | 0.034 |

TABLE 4

| Amount of sodium phosphate ($Na_3PO_4$) required to raise pH of tobacco/water mixture to 9.5 | | | |
|---|---|---|---|
| | Tobacco | Base required to raise pH to 9.5 | |
| Sample No. | Type & Mass (g) | Volume (mL) | Mass of base required per gram of tobacco (g) |
| 1 | Virginia 110.014 | 108.0 | 0.417 |
| 2 | Virginia 110.136 | 102.2 | 0.384 |
| 3 | Virginia 210.012 | 133.2 | 0.506 |
| 4 | Virginia 210.700 | 126.0 | 0.446 |
| 5 | Burley 110.093 | 100.0 | 0.377 |
| 6 | Burley 19.922 | 100.0 | 0.383 |
| 7 | Burley 29.922 | 116.0 | 0.440 |
| 8 | Burley 210.110 | 92.0 | 0.345 |

By altering the base used in the pH treatment process from $Na_2CO_3$ to a stronger base it may not only be possible to adjust the pH of the tobacco to a higher pH, but it may also be possible to reduce the volume of water added to the tobacco (and thereby reduce the drying required in the process).

Experiment 3

The following describes the laboratory process to adjust the pH of the tobacco using aqueous sodium hydroxide basic solution and evaluation of the resultant tobacco as a source of nicotine upon heating.

The tobacco to be treated (WWB) was dried overnight as before. As in Experiment 1, the moisture of the tobacco was then measured and the DWB calculated. For the pH adjustment with aqueous sodium hydroxide, 1.5 to 2.0 mMol of sodium hydroxide per gram of tobacco was used, where 50 mL of solution was added to 80 g of tobacco (DWB).

The sodium hydroxide basic solution was prepared by dissolving solid sodium hydroxide pellets in de-ionized water and placing into a 250 mL volumetric flask. The volume was then made up with de-ionized water to get the required volume of solution. 0.625 mL of this NaOH aqueous solution per gram of tobacco to be treated was then added to a spray bottle (where total volume of spray bottle is approximately 100 mL).

The tobacco batch to be treated was then split into two equal batches by mass (usually 80-100 g) and as before each batch placed in a container with an air tight lid. Half of the NaOH aqueous solution was then sprayed onto each batch of tobacco. The container containing the tobacco was then sealed and tumbled by placing in a laboratory rotator (for example a Stuart Laboratory Rotator) to mix the contents for a minimum of 5 minutes and up to 10 minutes.

The two batches of NaOH treated tobacco were then recombined and then transferred into another container suitable for drying, for example a large shallow tray. The container (open) was placed in a fume hood as before. The pH and moisture content were checked and recorded after 12 and then every 24 hours.

Following the drying of the tobacco, it was transferred into an airtight container and stored in a conditioning cabinet at 22° C. and 60% relative humidity (RH). During the first day of the storage, the lid of the container was not tightly fitted but was rather left ajar.

To analyze the tobacco for the nicotine released when the pH adjusted tobacco is heated, the adjusted tobacco was placed into a heating device, which was then attached to a mechanical smoking machine. The attached tobacco-filled heating device was then puffed upon following a set regime, documented as "Puff volume/Puff Duration/Frequency", which was programmed into the mechanical smoking machine. For example, the ISO smoking regime is 35 mL puff volume, 2 second puff duration, 60 puff frequency. Table 5 shows the measured nicotine deliveries for tobacco that has been pH adjusted using aqueous sodium hydroxide solution (2 mMol per gram of tobacco) at different smoking regimes, where the nicotine delivery is mg of nicotine per 375 mg of pH adjusted tobacco.

TABLE 5

| Nicotine delivery of pH adjusted tobacco at different smoking regimes, heated to 55° C., the tobacco having been treated with aqueous sodium hydroxide solution (2 mMol per gram of tobacco) | | | | |
|---|---|---|---|---|
| Puff Volume (mL) | Puff Duration (s) | Puff Frequency (s) | Number of Puffs | Nicotine Delivery (mg of nicotine per 375 mg of tobacco) |
| 35 | 2.0 | 30 | 10 | 0.013 |
| 35 | 5.0 | 30 | 10 | 0.015 |
| 35 | 9.0 | 30 | 10 | 0.014 |
| 50 | 1.5 | 30 | 10 | 0.017 |
| 50 | 5.0 | 30 | 10 | 0.033 |
| 50 | 9.0 | 30 | 10 | 0.036 |

TABLE 5-continued

Nicotine delivery of pH adjusted tobacco at different smoking regimes, heated to 55° C., the tobacco having been treated with aqueous sodium hydroxide solution (2 mMol per gram of tobacco)

| Puff Volume (mL) | Puff Duration (s) | Puff Frequency (s) | Number of Puffs | Nicotine Delivery (mg of nicotine per 375 mg of tobacco) |
|---|---|---|---|---|
| 100 | 2.5 | 30 | 10 | 0.091 |
| 100 | 5.5 | 30 | 10 | 0.070 |
| 100 | 9.0 | 30 | 10 | 0.085 |
| 150 | 3.0 | 30 | 10 | 0.107 |
| 150 | 6.0 | 30 | 10 | 0.113 |
| 150 | 9.0 | 30 | 10 | 0.099 |
| 250 | 3.0 | 30 | 10 | 0.189 |
| 250 | 6.0 | 30 | 10 | 0.199 |
| 250 | 9.0 | 30 | 10 | 0.220 |

Data for blend analysis of a typical batch of pH adjusted tobacco treated by sodium hydroxide (2 mMol per gram of tobacco) are shown below in Table 6.

TABLE 6

Blend analysis results of pH adjusted tobacco, adjusted using aqueous sodium hydroxide solution (2 mMol per gram of tobacco)

| Analysis of pH Adjusted Tobacco | | Blend of Burley & Virginia |
|---|---|---|
| Nicotine | Before | 3.31 |
| (DWB, %) | After | 2.98 |
| pH | Before | 5.9 |
| | After | 9.3 |
| Water by Near | Before | 10.0 |
| Infra-Red (NIR, %) | After | 11.0 |
| Ammonia Nitrogen | Before | 2.6 |
| (DWB, mg/g) | After | 1.5 |

Experiment 4

Following on from Experiments 2 and 3, Experiment 4 looked at reducing the volume of water added to the tobacco by increasing the concentration of aqueous sodium hydroxide solution.

Three concentrations of solution were investigated, 3.0 mol/L, 6.0 mol/L and 9.0 mol/L. Approximately 400 g of tobacco was oven dried for 48 hours at approximately 30° C. The moisture was then analyzed using the moisture balance. Three known masses of dried tobacco of approximately 40 g each were weighed and the dry weigh basis of the tobacco calculated.

$$WWB\ tobacco = DWB\ tobacco \Big/ \left(\frac{[100 - \text{moisture}]}{100}\right)$$

The volume of solution required for each of the three batches based on the mass of dried tobacco was then calculated and the mass of sodium hydroxide required to be added to each of the three batches (where 1.5 Mol of NaOH will be added per Kg of tobacco) and the concentration of the three solutions to provide the required amount of solid in the desired volume of solution was also calculated.

$$\text{mass of sodium hydroxide (in grams)} = \text{mass of } tobacco\ DWB \text{ (in grams)} \times 0.06$$

$$\text{Concentration of solution (in Mol per L)} = \left(\frac{\text{mass of sodium hydroxide}}{40}\right) \Big/ \text{volume}$$

The three sodium hydroxide solutions were then made up to the required concentrations in 250 mL volumetric flasks.

$$\text{mass of NaOH for 250 ml} = \text{Concentration} \times 0.250 \times 40$$

The first batch of tobacco was then placed in two crystal boxes in two equal portions and half of the solution was sprayed evenly over the surface of each of the two portions, the lids were added to the crystal boxes and placed in the rotator. The crystal boxes were rotated at a steady pace for 10 minutes. The pH of the tobacco was measured and the tobacco portion combined and dried as in experiments 1 and 3.

Table 7 below shows the blend analysis results for the same tobacco, pH adjusted using three different concentrations of aqueous sodium hydroxide solution (3.0, 6.0 and 9.0 mol/L). Analysis of these results shows that there is no statistically significant difference in the pH adjusted tobacco blend nicotine levels for this tobacco when treated with the three different concentrations of aqueous sodium hydroxide used in this study (p value of 0.150). This suggests that reduction in the volume of solution added to the tobacco can be achieved by increasing the concentration of the basic solution.

TABLE 7

Blend analysis of single tobacco type pH adjusted using three different concentrations of aqueous sodium hydroxide solution

| Concentration of NaOH solution used (mol/L) | Repeats | Nicotine (DWB, %) | Water by Near Infra-Red (NIR, %) | pH | Ammonia Nitrogen (DWB, mg/g) |
|---|---|---|---|---|---|
| 3.0 | 1 | 3.63 | 15.8 | 9.2 | 1.11 |
| | 2 | 3.58 | 16.0 | 8.9 | 1.78 |
| | 3 | 3.47 | 16.2 | 9.3 | 1.59 |
| 6.0 | 1 | 3.40 | 16.3 | 9.2 | 1.88 |
| | 2 | 3.53 | 15.9 | 8.8 | 2.41 |
| | 3 | 3.81 | 15.4 | 8.8 | 2.36 |
| 9.0 | 1 | 3.75 | 16.2 | 8.4 | 2.73 |
| | 2 | 3.73 | 15.2 | 8.7 | 2.63 |
| | 3 | 4.16 | 14.8 | 8.4 | 2.56 |

In order to address various issues and advance the art, the entirety of this disclosure shows by way of illustration various embodiments in which the claimed invention(s) may be practiced and provide for superior treated tobacco material, tobacco treatment processes, devices comprising the treated tobacco material and used of the treated tobacco. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. The order of any steps discussed or depicted herein is not limited to the examples given, such that the steps may be reordered, or steps may be added or omitted, in various other embodiments. In addition, the disclosure includes other inventions not presently claimed, but which may be claimed in future.

The invention claimed is:

1. A process for treating tobacco material to increase its pH to at least 9, the process comprising:

applying a basic liquid solution to a solid tobacco material to be treated;

removing ammonia from the solid tobacco material with added basic liquid solution; and drying the solid tobacco material to produce a treated tobacco material with a moisture content of no more than about 20 weight % based upon the dry weight of the tobacco, the drying being carried out at from about 20° C. to about 85° C.

2. A process according to claim 1, wherein the removal of ammonia and the drying of the solid tobacco material are carried out simultaneously or consecutively.

3. A process as claimed in claim 1, wherein the process comprises reducing the particle size of the solid tobacco material to from about 1 to about 3 mm.

4. A process as claimed in claim 3, wherein the particle size of the solid tobacco material is reduced before applying the basic liquid solution to the solid tobacco material.

5. A process as claimed in claim 3, wherein the solid tobacco material is sliced prior to the application of the basic liquid solution, and the particle size of the solid tobacco material is further reduced to a size of from about 1 to about 3 mm following application of the basic liquid solution.

6. A process as claimed in claim 1, wherein the basic liquid solution comprises a base selected from the group consisting of: sodium carbonate, sodium hydroxide and sodium phosphate.

7. A process as claimed in claim 6, wherein the basic liquid solution comprises sodium hydroxide.

8. A process as claimed in claim 7, wherein the sodium hydroxide solution has a concentration in the range of from about 3.0 to about 9.0 mol/L.

9. A process as claimed in claim 1, wherein the treated tobacco material is dried to have a moisture content of from about 5 to about 20% based on the dry weight of the solid tobacco material.

10. A process as claimed in claim 1, wherein the solid tobacco material is not heated to a temperature above about 65° C. during the treatment process.

11. A process as claimed in claim 1, wherein the solid tobacco material is mixed or agitated during or after application of the basic liquid solution.

12. A process as claimed in claim 3, wherein the process comprises reducing the particle size of the solid tobacco material to from about 1 to about 2 mm.

13. A process as claimed in claim 5, wherein the particle size of the solid tobacco material is further reduced to a size of from about 1 to about 2 mm following application of the basic liquid solution.

14. A process as claimed in claim 9, wherein the treated solid tobacco material is dried to have a moisture content of from about 8 to about 18% based on the dry weight of the solid tobacco material.

15. A process as claimed in claim 10, wherein the drying is carried out from about 20° C. to about 60° C. during the treatment process.

* * * * *